US005816716A

United States Patent [19]

Sugiyama

[11] Patent Number: 5,816,716

[45] Date of Patent: Oct. 6, 1998

[54] PRINTING APPARATUS HAVING A PLURALITY OF FEEDING MODES OF A PRINTING MEDIUM

[75] Inventor: Noriyuki Sugiyama, Kawasaki, Japan

[73] Assignee: Canon Kabushiki Kaisha, Tokyo, Japan

[21] Appl. No.: 916,372

[22] Filed: Aug. 22, 1997

Related U.S. Application Data

[63] Continuation of Ser. No. 512,409, Aug. 8, 1995, abandoned.

[30] Foreign Application Priority Data

Aug. 12, 1994 [JP] Japan ..... 6-190481
Jul. 27, 1995 [JP] Japan ..... 7-192270

[51] Int. Cl.[6] ..... B41J 11/44

[52] U.S. Cl. ..... 400/76; 400/582; 400/605

[58] Field of Search ..... 400/578, 582, 400/596, 605, 607.2, 624, 76

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,396,307 | 8/1983 | Shah et al. | 400/625 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,786,920 | 11/1988 | Igarashi | 400/70 |
| 4,789,259 | 12/1988 | Katayanagi | 400/624 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—John S. Hilten
*Attorney, Agent, or Firm*—Fitzpatrick, Cella, Harper & Scinto

[57] ABSTRACT

In a printing apparatus, in which an automatic feeding mode and a manual feeding mode are set in feeding a printing medium, setting of state of feeding unit depending upon respective feeding modes is performed automatically in accordance with a command input relating to a size of the printing medium to be used.

12 Claims, 14 Drawing Sheets

| AUTOMATIC FEEDING REGISTERED SIZE |
| --- |
| A3 PORTRAIT |
| A4 PORTRAIT, LANDSCAPE |
| B4 PORTRAIT |
| B5 PORTRAIT, LANDSCAPE |
| LETTER PORTRAIT, LANDSCAPE |
| LEGAL PORTRAIT |

FIG. 10

| AUTOMATIC FEEDING REGISTERED KINDS | |
|---|---|
| NORMAL PAPER A3 PORTRAIT | NORMAL PAPER B5 PORTRAIT |
| NORMAL PAPER A4 PORTRAIT | NORMAL PAPER B5 LANDSCAPE |
| NORMAL PAPER A4 LANDSCAPE | NORMAL PAPER LETTER PORTRAIT |
| NORMAL PAPER B4 PORTRAIT | NORMAL PAPER LETTER LANDSCAPE |
| NORMAL PAPER LEGAL PORTRAIT | |

FIG. 13

| KIND OF PRINTING SHEETS | | |
|---|---|---|
| NORMAL A3 PORTRAIT | SPECIAL A3 PORTRAIT | ENVELOP US NO.10 PORTRAIT |
| NORMAL A4 PORTRAIT | SPECIAL A4 PORTRAIT | ENVELOP US NO.10 LANDSCAPE |
| NORMAL A4 LANDSCAPE | SPECIAL A4 LANDSCAPE | ENVELOP DL PORTRAIT |
| NORMAL B4 PORTRAIT | SPECIAL B4 PORTRAIT | ENVELOP DL LANDSCAPE |
| NORMAL B5 PORTRAIT | SPECIAL B5 PORTRAIT | POSTCARD PORTRAIT |
| NORMAL B5 LANDSCAPE | SPECIAL B5 LANDSCAPE | POSTCARD LANDSCAPE |
| NORMAL LETTER PORTRAIT | SPECIAL LETTER PORTRAIT | OTHERS |
| NORMAL LETTER LANDSCAPE | SPECIAL LETTER LANDSCAPE | |
| NORMAL LEGAL PORTRAIT | SPECIAL LEGAL PORTRAIT | |

FIG. 14

PRINTING APPARATUS HAVING A PLURALITY OF FEEDING MODES OF A PRINTING MEDIUM

This application is a continuation of application Ser. No. 08/512,409, filed Aug. 8, 1995, now abandoned.

BACKGROUND OF THE INVENTION

1. Field of the Invention

The present invention relates generally to a printing apparatus. More specifically, the invention relates to a printing apparatus which can switch modes for feeding a printing medium between an automatic feeding mode and a manual feeding mode.

2. Description of Prior Art

Among printing apparatus of the type having a construction capable of switching feeding modes, there is a printing apparatus having set portions of printing medium in the case of an automatic feeding mode and in the case of a manual feeding mode, on a common feeding path. In such printing apparatus, corresponding to respective feeding modes to be switched, set portions of the printing medium has to be set. Such setting is generally performed as setting of a stand-by condition of a feeding means before setting the printing medium in a feeding path. Conventionally, a command input and so forth for such setting has been performed by an operator.

On the other hand, switching of the feed mode is generally performed depending upon the size of the printing medium and orientation, i.e. landscape orientation or portrait orientation of the printing medium, namely depending upon format of document to be printed and/or kind of the printing medium, e.g. normal paper, postcard and so forth.

Accordingly, if the feeding mode has to be switched by the operator, judgment for the format of the document to be printed and/or the kind of the printing medium has to be made. In addition, it is required to enter a command input for appropriate setting depending upon the judgment made.

In such conventional printing apparatus, when switching of the feeding mode, namely setting of the stand-by state of the feeding means, the operator is forced to have excessive load. Also, when erroneous command input is made, the printing medium may be damaged or failure of the printing apparatus may be caused.

SUMMARY OF THE INVENTION

It is an object of the present invention to provide a printing apparatus which can automatically select a feeding mode of a printing medium on the basis of information relating to a format of document to be recorded, such as size, kind and so forth, of the printing medium and so forth, and can perform switching of the feeding mode depending upon the mode selected.

In an aspect of the present invention, there is provided a printing apparatus for performing printing on a printing medium by using a printing head, comprising:

- a feeding means for feeding the printing medium to a printing region, in which printing is performed by means of the printing head, the feeding means being operable in each of a plurality of feeding modes;
- an input means for inputting information relating to an editing format of a document;
- a mode judgment means for making judgment of a feeding mode corresponding to the printing medium on the basis of information input by the input means; and

- a mode setting means for setting the feeding mode of the feeding means on the basis of the judgment made by the mode judgment means.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings:

FIG. 10 is an illustration showing a content of a table storing a data of sheets which can be automatically fed in the automatic feeding mode of the first embodiment;

FIG. 13 is an illustration showing a content of a table storing data regarding kinds of sheets which can be automatically fed in the automatic feeding mode of the second embodiment of the printing apparatus;

FIG. 14 is an illustration showing the contents of a table storing kinds of sheets in the second embodiment.

DESCRIPTION OF PREFERRED EMBODIMENTS

The preferred embodiments of a printing apparatus according to the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other words, well-known structures are not shown in detail in order to avoid unnecessarily obscuring the present invention.

A First Embodiment

Figure 1:
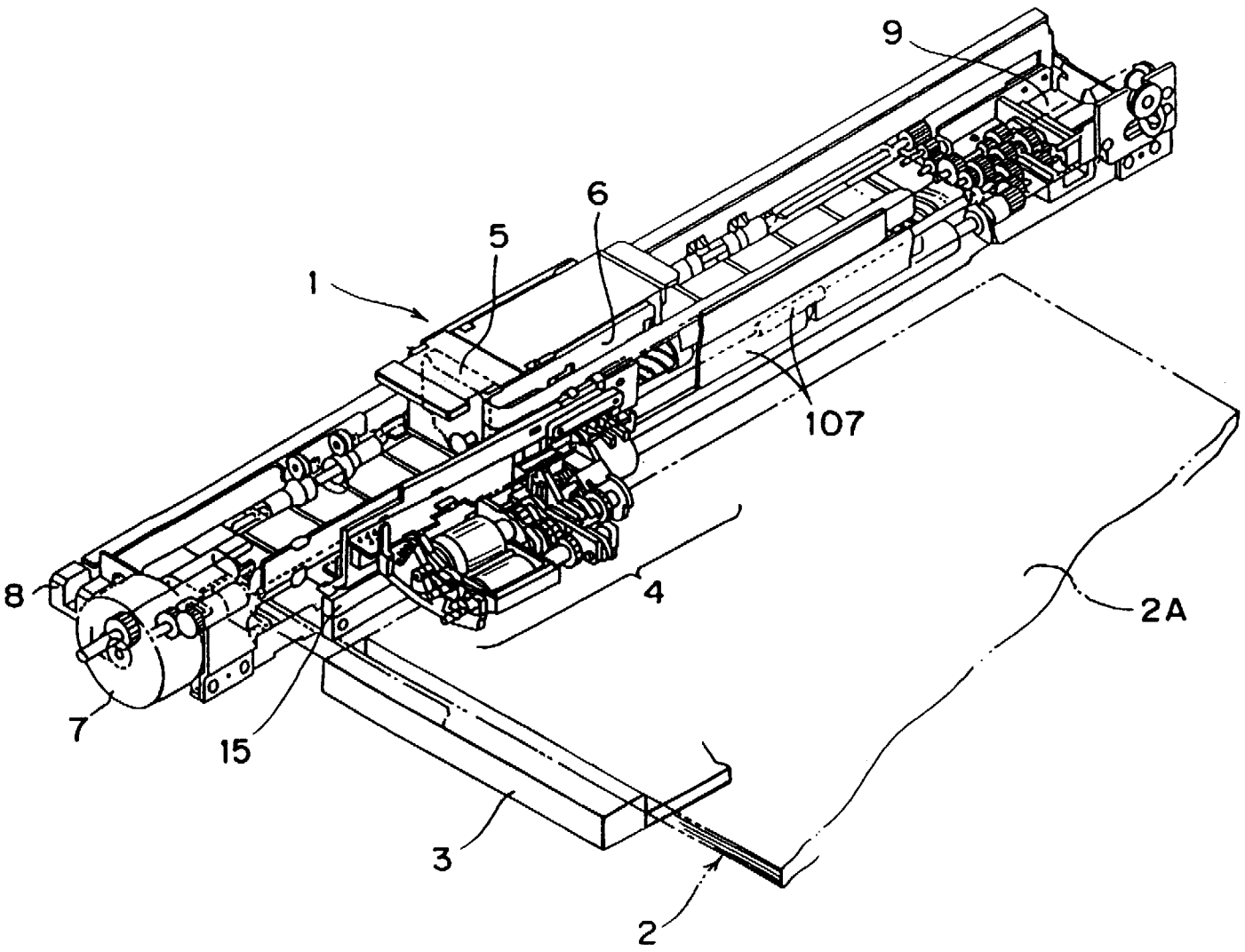
FIG. 1 is a perspective view showing a construction around a printing portion and an feeding portion in an embodiment of a printing apparatus according to the present invention.

FIG. 1 shows a construction of a first embodiment of a printing apparatus, to which the present invention is applied. The printing apparatus of the shown embodiment shows an example of a serial type ink-jet printing apparatus, in which ejection of ink on a printing sheet as a printing medium associating with scanning of a printing head of the printing apparatus. Here, the reference numeral 1 denotes a printing portion, a reference numeral 2 denotes a printing sheet stack held in a condition stacked on a sheet feeding base 3, a reference numeral 4 denotes a feeding portion for feeding a recording sheet 2A positioned at uppermost position in a printing sheet stack 2 to a printing position one-by-one, and a reference numeral 5 denotes a printing head mounted on a carriage 6 and shifted for scanning along a surface of the printing sheet 2A by driving of a carriage drive motor 7.

In the construction set forth above, while shifting of the printing head 5, ink is ejected from the recording heads 5 toward the printing sheet 2A at a predetermined timing, so that recording is performed. A reference numeral 8 denotes a home position (HP) sensor for detecting recording head 5 positioned at the home position out of a printing region as defined along the printing sheet 2A, and a reference numeral 9 denotes a sheet feeder motor for feeding the printing sheet 2A in a distance corresponding to a width of ejection orifice arrays of the head 5 every time of completion of printing for one scanning line by the printing head 5. It should be noted that while not illustrated, in the printing portion 1, a paper sensor is provided for detecting the printing sheet 2A when the leading end of the printing sheet reaches a predetermined position for positioning.

The construction of the feeding portion 4 shown in FIG. 1 will be discussed in detail with reference to FIGS. 2 to 4. The feeding portion 4 of the shown embodiment differentiates stand-by states which determine a sheet setting position upon performing sheet feeding between an automatic feed mode and a manual feed mode, respectively.

Figure 2:
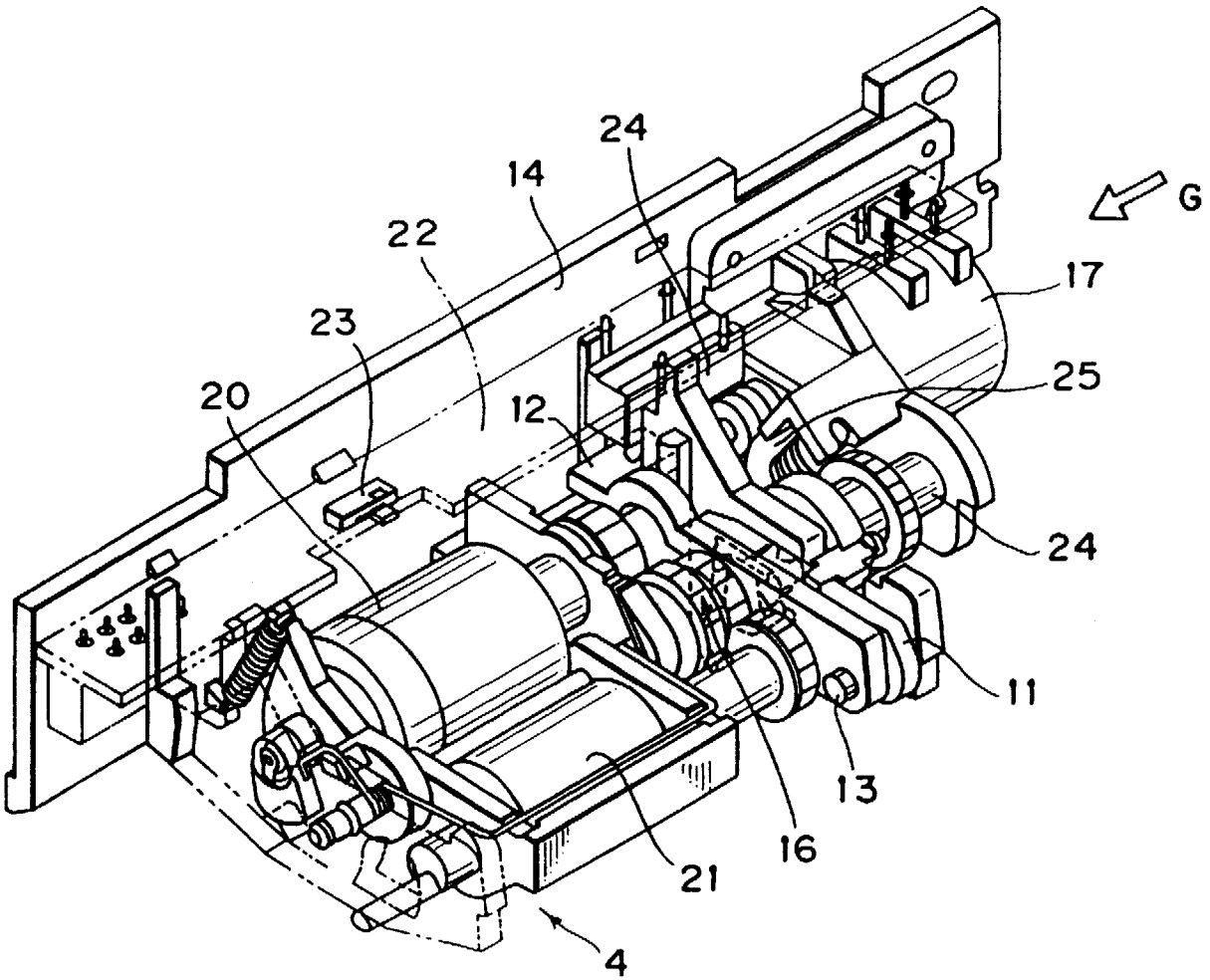
FIG. 2 is a perspective view showing detailed construction of the feeding portion shown in FIG. 1.

In FIG. 2, a reference numeral 11 denotes a sheet stopper for positioning of the printing sheet stack 2 with the leading end thereof upon setting of the printing sheet stack 2 on the feeding base 3, shown in FIG. 1. The sheet stopper 11 and an initial lever 12 associated with the initial position of the feeding portion 4 are supported by a support shaft 13 in a swingingable fashion for swinging motion thereabout. A reference numeral 14 denotes a main holder supporting the whole body of the feeding portion 4 and fixedly secured on a frame 15 (see FIG. 1) of the printing apparatus.

The sheet stopper 11 and the initial lever 12 are both engaged to the cam gear 16. A reference numeral 17 denotes a feeding motor. The cam gear 16 is driven by the feeding motor 17 during automatic feeding.

The construction of the cam gear 16 will be discussed with reference to FIG. 3.

Figure 3:
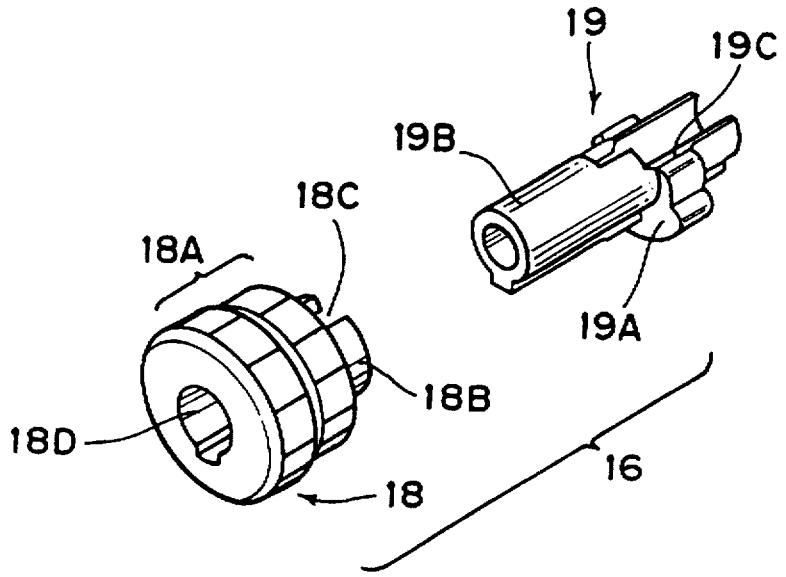
FIG. 3 is a perspective view of the feeding portion, in which a construction of a cam gear is shown in an exploded manner.

As shown in FIG. 3, the cam gear 16 is constructed with a gear member 18 and a cam member 19 integrally engaged with the gear member 18 in coaxial fashion. A gear portion 18A of the gear member 18 meshes with gears of a separation roller 20 and a preparatory roller 21 shown in FIG. 2 so as to simultaneously drive those rollers upon automatic feeding. A reference numeral 18B denotes a cam portion integrally formed with the gear member 18, and a reference numeral 18C denotes a cam groove formed in the cam portion 18B. A projecting portion 12A (see FIG. 4) of the initial lever 12 is engaged with the cam groove 18C. The operation of the initial lever 12 will be discussed later. Also, a cam member 19 has a cam portion 19A (hereinafter referred to as "stopper lifting cam") engaging with recess portion (see FIG. 5) of the sheet stopper 11. A reference numeral 19B denotes an engaging shaft fixedly engaged in an engaging shaft hole 18D of the gear member 18.

Referring again to FIG. 2, a reference numeral 22 denotes a base plate fixed to a main holder 14. A reference numeral 23 denotes a feeding changeover switch, and a reference numeral 24 denotes a feed initial position sensor mounted on the lower surface side of the base plate 22. The feed initial position sensor 24 is adapted to detect the initial position in the automatic feeding by swinging motion of the initial lever 12 which will be discussed later. It should be noted that the afore-mention feeding motor 17 is a stepping motor, in the shown embodiment. The stepping motor is driven by double-pole driving by double phase excitation to cause one cycle of revolution in twenty steps. A reference numeral 25 denotes a two step gear for transmitting a driving force of the motor 17 to an output gear 26 at the side of the cam gear 16.

Next, discussion will be given for an automatic feeding mode and a manual feeding mode with reference to FIGS. 4 to 6. At first, an initial position detecting operation in the automatic feeding mode will be discussed with reference to FIG. 4 and 5.

Figure 4:
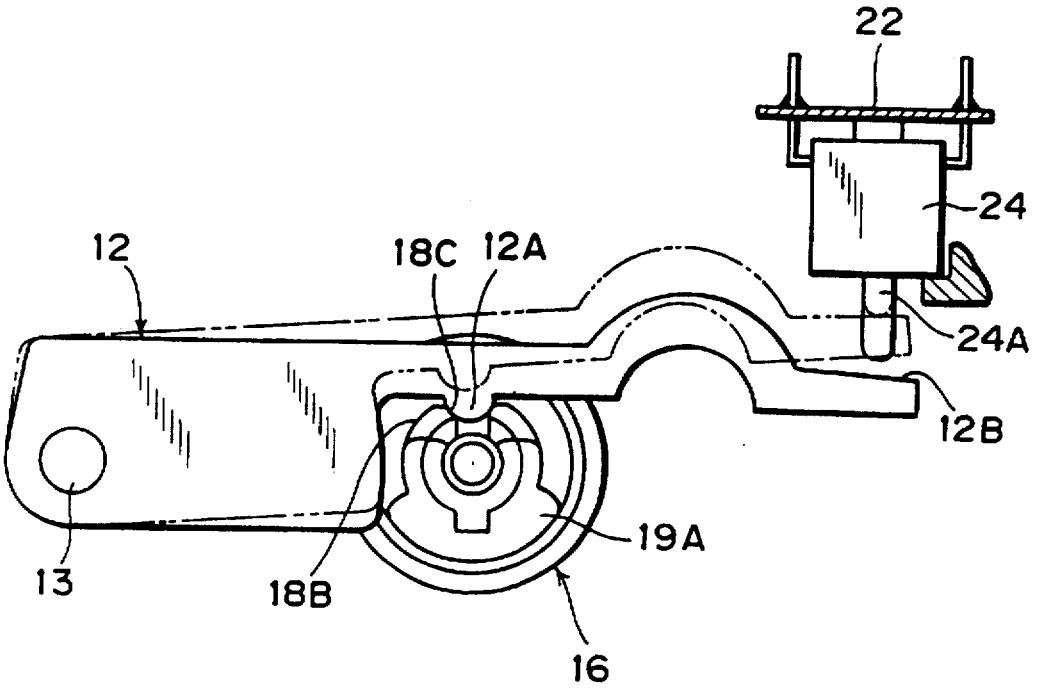
FIG. 4 is an explanatory illustration showing a construction of a home position detecting portion in the feeding portion of FIG. 1.

As shown in FIG. 4, on the initial lever 12, an actuating portion 12B is formed at the swinging side end. An actuator portion 24A of the feed initial position sensor 24 is positioned in opposition to the upper surface of the actuating portion 12B of the initial lever 12.

In the condition where the projecting portion 12A of the initial lever 12 is dropped into the cam groove 18C of the cam gear 16 as illustrated in FIG. 4, the actuating portion 12B of the initial lever 12 does not contact with the actuator portion 24A of the feed initial position sensor 24. At this condition, the feed initial position sensor 24 outputs "ON" signal to a control portion which will be discussed later. By this, the state where the feeding portion 4 is maintained at the initial condition, namely, the stand-by state of the automatic feeding mode, can be detected. Also, at this initial state, a flat surface 19C of a cam member 19 in the cam gear 16 is held in the position dropped into the recessed portion 11A of the sheet stopper 11, as shown in FIG. 5A.

Figure 5A:
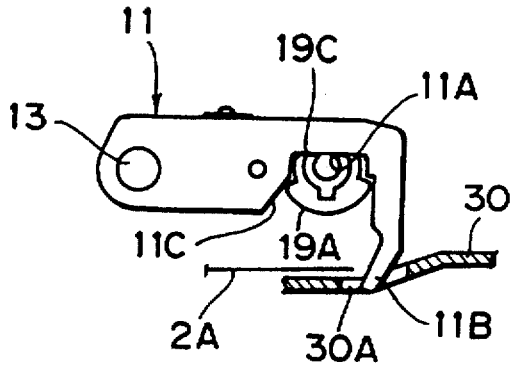
FIGS. 5A to 5D are explanatory illustrations showing stand-by state in an automatic feeding mode of the above-mentioned feeding portion.
Figure 5B:
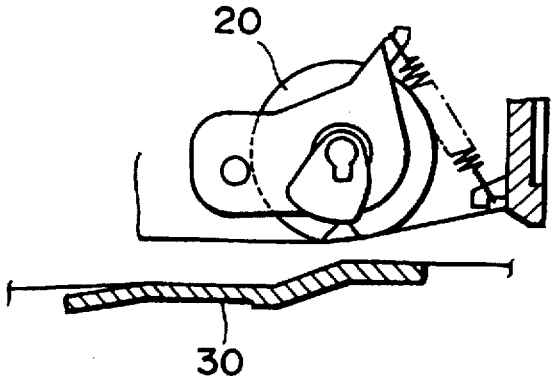
Figure 5C:
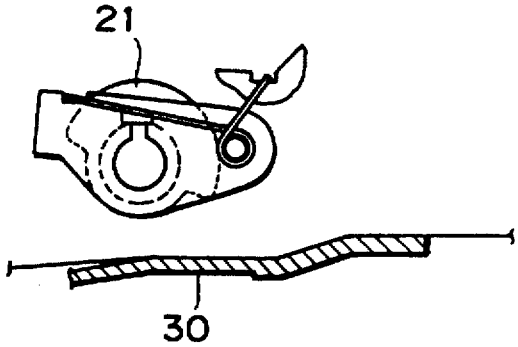
Figure 5D:
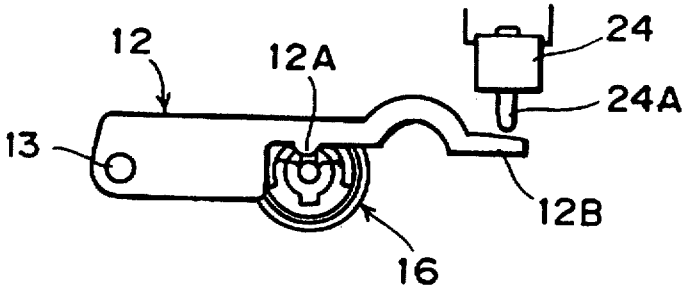

More specifically, at this condition, as shown in FIG. 5A, a positioning claw 11B of the sheet stopper 11 is held in the condition dropped into an engaging hole 30A of a sheet guide plate 30. By this, the printing sheet 2A is blocked by the positioning claw 11B at the leading end thereof and thereby prevented from being further fed. The printing sheet position which is determined as set forth above, is the set position of the printing sheet in the automatic feeding mode. Also, this printing sheet position condition corresponds to a position of the stand-by state of the feeding portion 4. Furthermore, in such initial condition, the separation roller 20 and the preparatory roller 21 are positioned above the sheet guide plate 30 as shown in FIGS. 5B and 5C. Therefore, between the separation roller 20, the preparatory roller 21 and the sheet guide plate 30, a sufficient path for introducing the printing sheet 2A is certainly defined. It should be noted that the automatic feeding operation, such as the operation of the separation roller 20 and the preparatory roller 21 in the process for feeding the printing sheet 2A after releasing such initial condition, are known per se. Therefore, a discussion thereof is neglected to keep the disclosure simple enough to facilitate clear understanding of the invention.

Figure 6A:
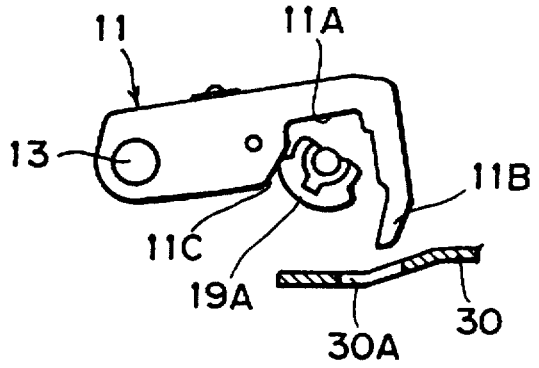
FIGS. 6A to 6D are explanatory illustrations showing stand-by state in a manual feeding mode of the above-mentioned feeding portion.
Figure 6B:
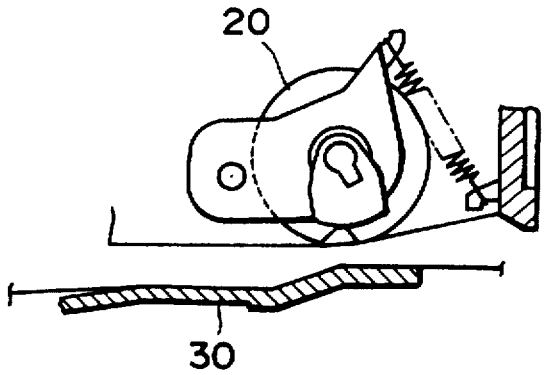
Figure 6C:
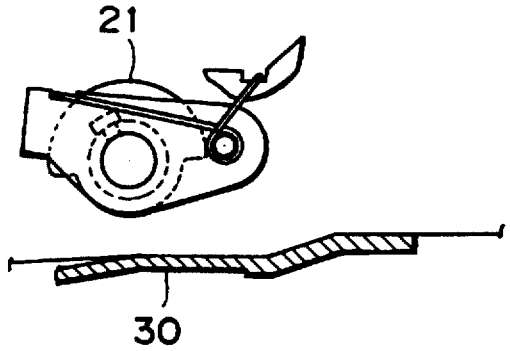
Figure 6D:
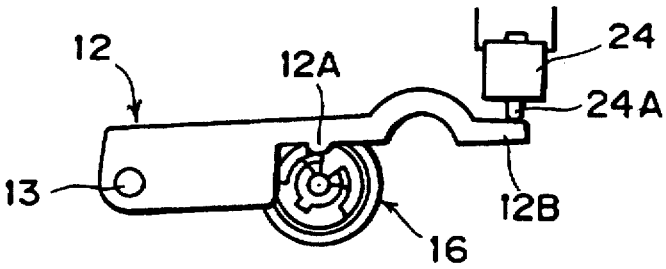

FIGS. 6A to 6D show stand-by state of the feeding portion in the manual feeding mode. The shown condition is obtained by rotating the cam gear 16 approximately 30 degrees in clockwise direction from the initial position shown in FIG. 4. Namely, by such rotation of the cam gear 16, the initial lever 12 swings upwardly as shown by broken line in FIG. 4. Then, associated with this swinging motion, the actuator portion 24A of the feed initial position sensor 24 is pushed upwardly by the actuating portion 12B to turn OFF the output signal of the feed initial position sensor 24. FIG. 6D shows such condition. In conjunction therewith, since the cam portion 19A of the cam member 19 of the cam gear 16 slidingly contact with a pushing up surface 11C of the sheet stopper 11 to pivot the sheet stopper 11 in the counterclockwise direction. Thus, the positioning claw 11B of the sheet stopper 11 is positioned in a condition lifted from the engaging hole 30A of the sheet guide plate 30. In this state, the separation roller 20 and the preparatory roller 21 are held above the sheet guide plate 30 as shown in FIGS. 6B and 6C.

In the feeding stand-by state in the manual feeding mode obtained as set forth above, the printing sheet is inserted until the leading end thereof abut against a nip portion of a feed roller pair 107 (see FIG. 1). This inserted position of the printing sheet is the sheet set position in the manual feeding mode. A transporting of the printing sheet by the feed roller pair 107 are known per se. Therefore, discussion therefore is neglected.

Switching between the manual feed mode and the automatic feed mode may be performed through the changeover switch 23 (see FIG. 2). However, as discussed later, the shown embodiment enables automatic switching of the feeding mode depending upon the format set with respect to the printing sheet to be fed.

Figure 7:
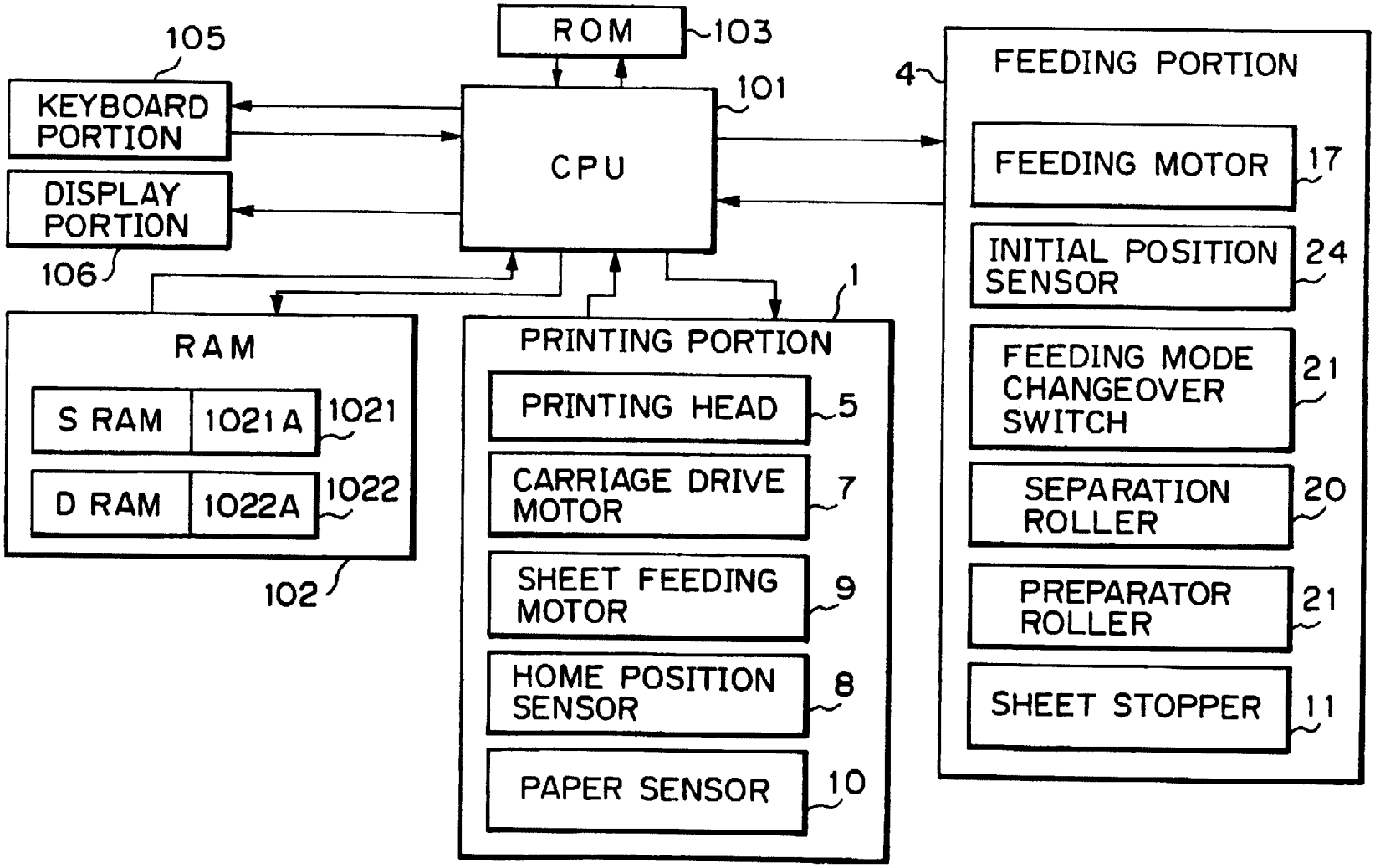
FIG. 7 is a block diagram showing a construction of a control system of the printing apparatus shown in FIG. 1.

FIG. 7 shows a construction of a control system of the printing apparatus illustrated in FIG. 1. Here, a reference numeral 101 denotes a central processing unit (CPU) in a form of a micro-processor and controls the process operation of the overall printing apparatus, and performs processes discussed later with reference to FIGS. 8 and 9. A reference numeral 102 denotes a RAM in the printing apparatus. A RAM 102 includes a SRAM 1021 maintaining the storage content even after turning OFF the power source by a back-up means, such as a lithium battery or so forth, and a DRAM 1022 which is erased the storage content upon turning OFF the power source. Reference numerals 1021A and 1022A denote storage regions provided in, respectively of the SRAM 1021 and the DRAM 1022. In the storage region 1021A are stored, feeding modes depending upon the format of data to be printing, such as size of the printing sheet and so forth, which will be discussed later. On the other hand, the storage region 1022A is used as work area for developing of the text data, graphic data and so forth. In addition, the storage region 1022A is also used as a region for storing a feeding mode switching condition. It should be noted that the storage region 1022A of the DRAM 1022 is set to have a value "0" when the power source is turned from the "OFF" position to the "ON" position.

A reference numeral 103 denotes ROM. A ROM 103 stores various programs corresponding to the process to be executed by the CPU 101, fixed data, such as a character generator, drive table of respective driving sources, registered sized of the sheets for automatic feeding which is discussed later. A reference numeral 105 denotes a keyboard portion having input keys for inputting character, figure, sign and so forth and various command including a setting of the printing condition. A reference numeral 106 denotes a display portion including a display unit. It should be noted that the reference numeral 10 denotes a paper sensor provided in the printing portion 1. The paper sensor 10 is designed for detecting the printing sheet 2A introduced in a position immediately before initiation of printing.

The control process of the feed mode switching operation in the printing apparatus as set forth above will be discussed with reference to FIGS. 8 and 9.

Upon starting process of a document drafting mode by command input through the keyboard portion 105, selection input for selecting either new document drafting or editing of already stored document is waited at a step S1. In response to a command input selecting either new document drafting or editing of already stored document, judgment is made whether drafting of a new document is selected or not depending upon the content of the command input through the keyboard portion 105, at a step S2. When judgment is made that new document drafting is selected, the process is advanced to a step S3. At the step S3, the process state becomes a waiting state awaiting an input for setting a printing condition associated with a document format. Once the printing condition is set at the step S3, judgment is made whether the set printing condition is a registered condition for performing automatic feeding of the sheet as shown in FIG. 10, or not, at a step S4. Namely, at the step S4, judgment is made whether the sheet size corresponding to the setting of the printing condition associated with the document format is one of the registered size, e.g. portrait orientation of A3, portrait and landscape orientations of A4, portrait orientation of legal size, or not, by making reference to the table having the content shown in FIG. 10. On the other hand, at a step S2, when judgment is made that the command input does not designate editing of a new document, namely, when one of the already stored documents is selected, the process is advanced to the step S4 for making judgment whether the selected document has the sheet size corresponding to one of the registered sizes for performing automatic feeding or not.

As set forth, when judgment is made that the set printing condition corresponds to the automatic feeding of the sheet as judged at the step S4, judgment is made whether the feeding portion 4 is in the stand-by state in the automatic feeding mode at a step S5. Namely, the value of the storage region 1021A storing the feeding mode is "0" before judgment at the step S5, judgment is made that the automatic feeding mode is already selected. By this, judgment is made that the feeding portion 4 is held in a stand-by state in the automatic feeding mode. Therefore, the state need not be switched. Then, at a step S6, "0" is set in the feeding mode switching storage region 1022A. Namely, when the feeding mode is required to be switched, the content of the feeding mode switching storage region 1022A is set to "1". On the other hand, when the feeding mode is not required to be switched, the content of the feeding mode switching storage region 1022A is set to "0".

When the process at the step S6 is completed, at steps S10 and S11, input for drafting a document is enabled until termination of document drafting, such as by key input for commanding drafted document storage. Then, when judgment is made that termination of document drafting is commanded as checked at the step S11, the document drafting mode is terminated.

On the other hand, when the value in the feeding state storage region 1021A is "1" as judged at the step S5, and thus judgment is made that the manual feeding mode is already selected, and then the feeding portion 4 is in the stand-by state in the manual feeding mode. Therefore, it becomes necessary to switch the feeding mode to the stand-by state in the automatic feeding mode, and at a step S7, the value "1" is set in the feeding mode switching storage region 1022A. Then the similar control set forth above is performed through the step S10 and subsequent steps.

In the judgment at the step S4, when judgment is made that the set sheet size is not the registered size of the automatic feeding, judgment is made whether the feeding portion 4 is placed at the stand-by state in the manual feeding mode, at a step S8. At this time, if the value stored in the feeding mode storage region 1021A is "1", judgment can be made that the manual feeding mode is already selected. On the other hand, since the feeding portion 4 is maintained at stand-by state of the manual feeding mode, the state has not to be switched. Then, the process is advanced to the step S6, the process is advanced to similarly perform the subsequent processes. On the other hand, at the step S8, when the value of the content of the feeding condition storage region 1021A is "0" and thus judgment is made that the automatic feeding mode is already selected, and the feeding portion 4 is in the stand-by state of the automatic feeding mode. Therefore, the state of the feeding portion 4 has to be switched into the stand-by state in the manual feeding mode, and at a step S9, after setting "1" in the feeding mode switching storage region 1022A, the process of the step S10 and subsequent process are performed similarly.

Figure 8:
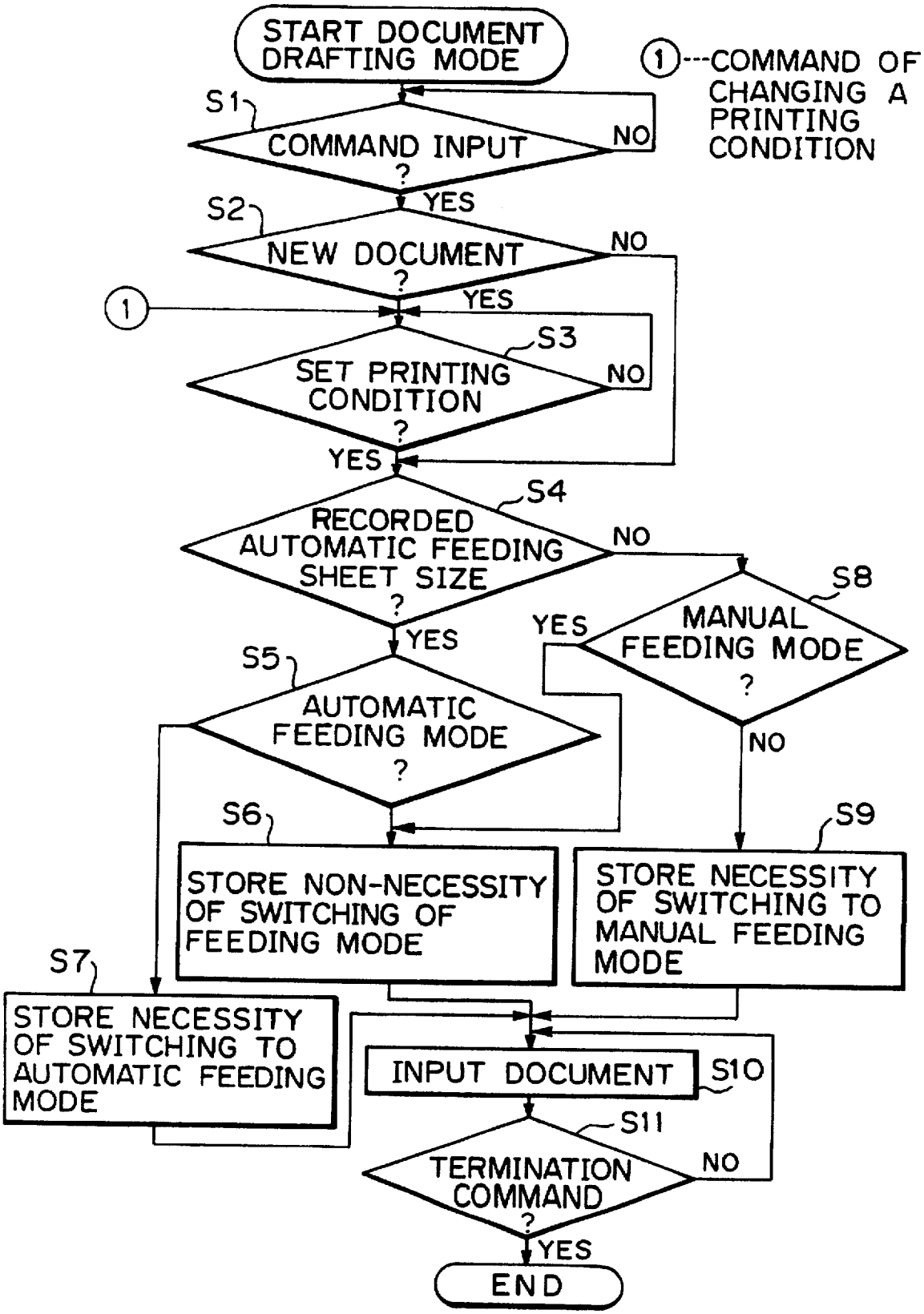
FIG. 8 is a flowchart showing a procedure for a pre-process of a feeding mode switching in a document drafting mode of a first embodiment of the present invention.

In addition, changing of the printing condition is commanded at in FIG. 8 by key input, the process from the step S3 is performed.

Next, control process in practical feeding mode switching operation will be discussed with reference to FIG. 9.

When the document printing mode is initiated in response to command input through the keyboard portion 105, judgment is made whether the data A stored in the feeding mode switching storage region 1022A is "0" or "1" at a step S12. When judgment is made that the data A is "0", it is not required to switch the state of the feeding portion 4. At a step S13, the user manually sets the printing sheet.

At this time, since the feeding portion 4 is the stand-by state in the automatic feeding mode, the set printing sheet abuts the leading end thereof to the sheet end positioning portion of the sheet stopper 11. By this, the leading end of the sheet is positioned and the printing sheet is set. In contrast to this, the feeding portion 4 is in the stand-by state in the manual feeding mode, the leading end of the sheet is set to reach the feed opening defined by the feeding rollers 107 of the printing portion 1.

At a step S14, when the setting for printing or setting of header and footer is changed, this command is received. If the preliminary set printing condition or header and footer is not required to be changed, judgment is made depending upon the predetermined key input for initiation of printing, directly at the step S15. Judgment is made that the initiation of printing is input, the process is advanced to the step S16 to perform printing. Thereafter, the document printing mode is terminated.

On the other hand, when judgment is made that the data A is not "0" as checked at the step S12, namely the value stored in the feeding mode switching storage region 1022A is "1", the current state of the feeding portion 4 has to be switched. Then, at a step S17, judgment is performed whether a data B stored in the feeding mode storage region 1021A is "0" or "1". If the data B is judged as "0", the current state of the feeding portion 4 is judged as the stand-by state of the automatic feeding mode. Next, at a step S18, in order to switch the feeding portion 4 to the stand-by state of the manual feeding mode, the feeding motor 17 is driven for 427 steps in the counterclockwise direction (forward driving) as viewed from the direction G in FIG. 2 to rotate the cam gear 16 approximately 30 degrees in the clockwise direction.

Thereafter, at a step S19, the value "1" is set in the feeding mode storage region 1021A. Subsequently, at a step S20, the value "0" is set in the feeding mode switching storage region 1022A. Then, the process is moved to the step S13 to perform control in the similar process to those as set forth above.

On the other hand, when judgment is made that the data B is not "0", namely, when the content of the feeding mode storage region 1021A is "1", judgment is made that the current state of the feeding portion 4 is the stand-by state in the manual feeding mode. Therefore, at a step S21, the cam gear 16 is rotated over 330 degrees (360–30) degrees in the direction as set forth above. Thus, for switching the state of the feeding portion 4 to the stand-by state in the automatic feeding mode, the feeding motor 19 is driven to rotate in forward direction for 4693 steps. Thereafter, at a step S22, the value "0" is set in the feeding mode storage region 1021A. Then, at the step S20 and subsequent processes, control is performed in the similar process as set forth above through the steps S13 to S16.

As set forth above, in the shown embodiment, at the timing setting the printing sheet, in response to setting of the printing condition associated with the printing sheet, the stand-by state of the feeding portion is automatically set. Therefore, the operator is not required troublesome judgment and can obtain the state corresponding to the printing sheet.

In the foregoing first embodiment, the registered condition of the automatic feeding sheet is set in a range as shown in FIG. 10. However, the printing sheets to be automatically fed are determined depending upon the specification of the apparatus. Therefore, the printing sheets listed in FIG. 10 are not exhaustive but should be appreciated as mere examples. In case where the printing sheet other than those listed in FIG. 10 can be used for automatic feeding, the registered condition is naturally differentiated. Therefore, the printing sheets to be automatically fed are not limited to those shown in FIG. 10. Also, similar effect may be attained by permitting the user to freely set the printing sheet to be registered for automatic feeding within a range permitted by the specification of the apparatus.

A Second Embodiment

In the first embodiment as set forth above, the automatic feeding mode and the manual feeding mode are automatically selected on the basis of the size of the printing sheet depending upon the document format defined in the set printing condition and the state of the feeding portion is switched depending upon the selected feeding mode. In contrast to this, the shown embodiment makes judgment of the feeding mode between the automatic feeding mode and the manual feeding mode on the basis of the kind of the printing sheet to be used, and switching of the state of the feeding mode is performed on the basis of this judgment.

Figure 9:
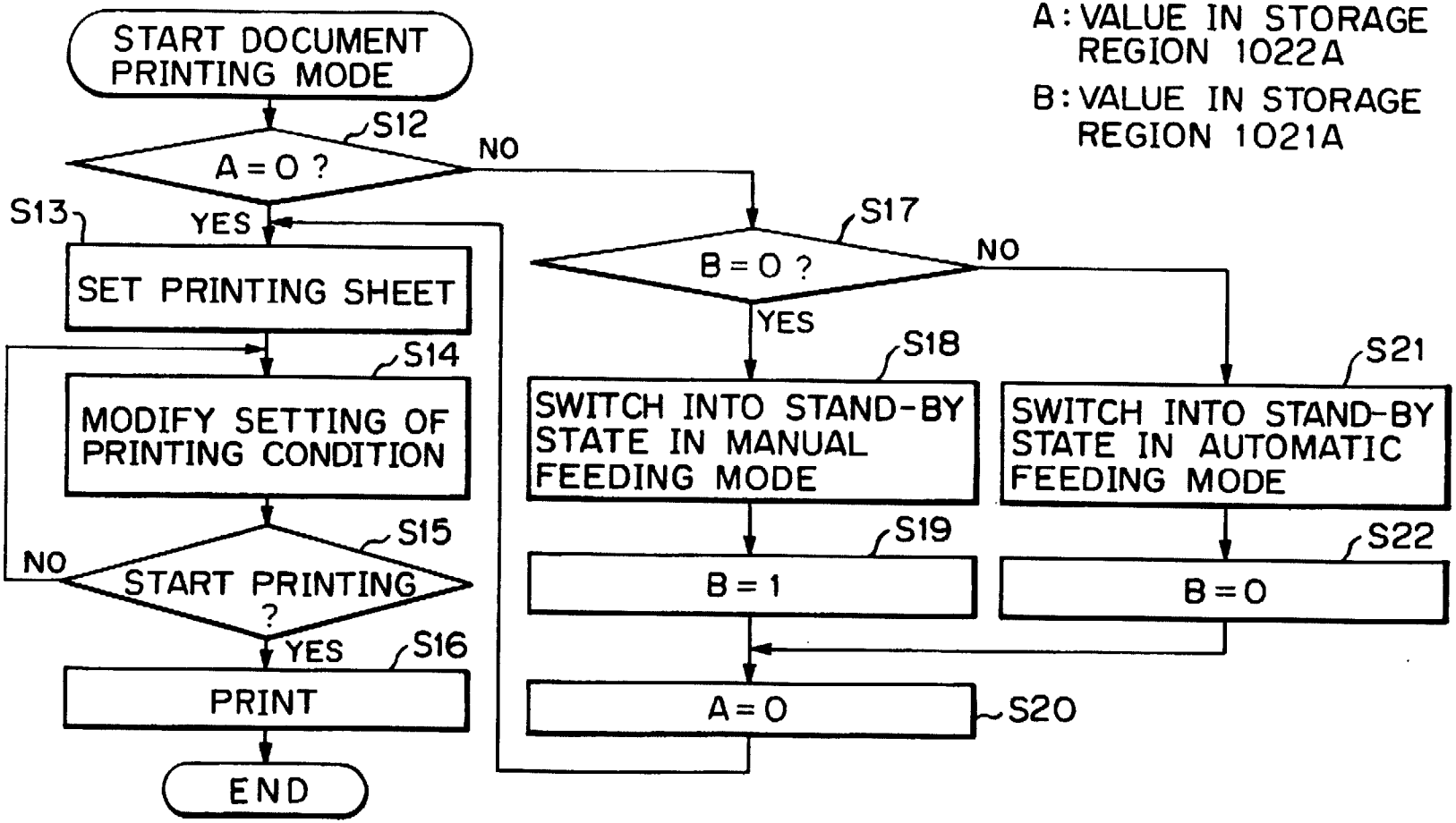
FIG. 9 is a flowchart showing a procedure of stand-by state switching process responsive to switching of the feeding mode in the document printing mode of the first embodiment.
Figure 11:
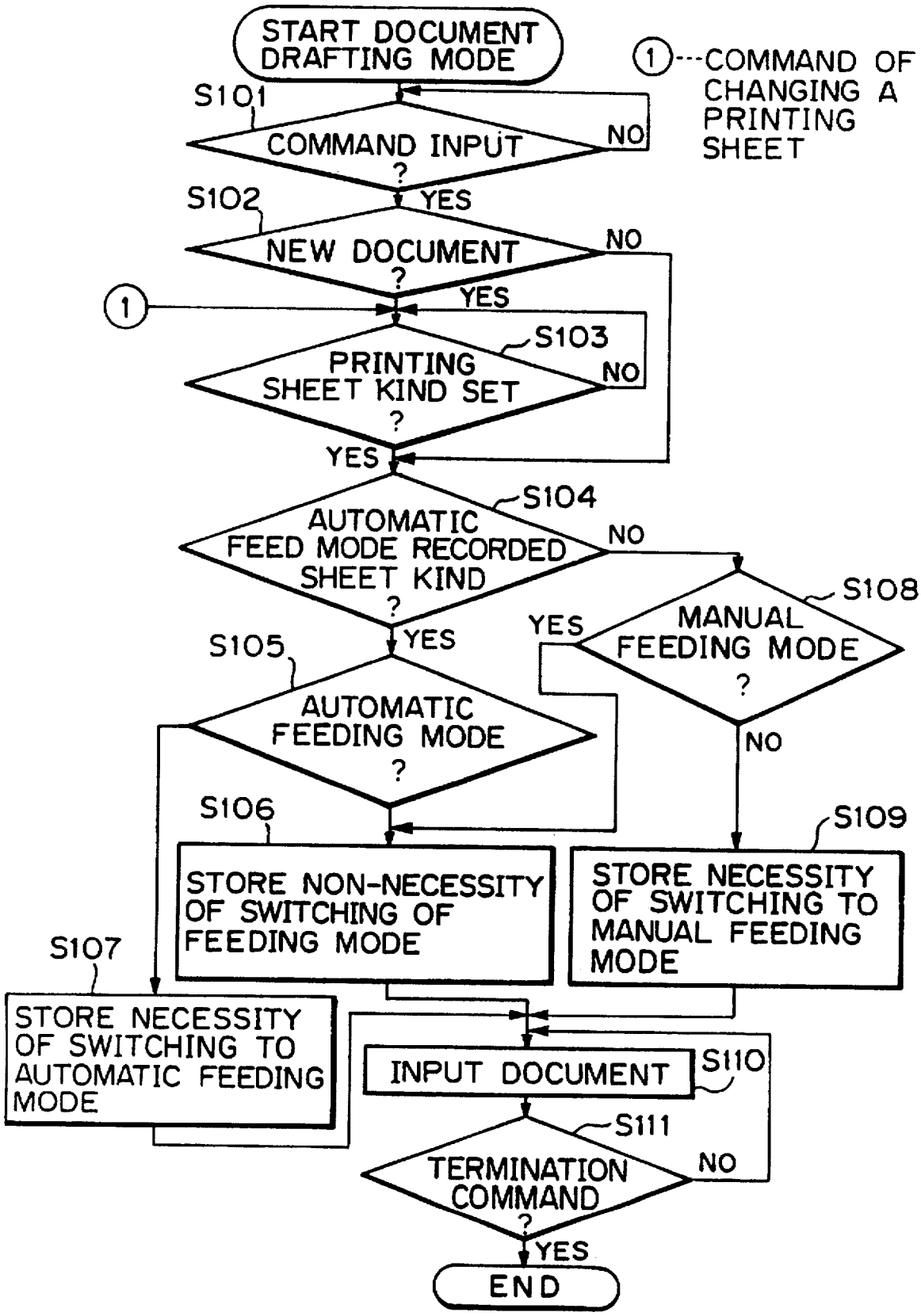
FIG. 11 is a flowchart showing a procedure of a pre-process of a feeding mode switching in a document drafting mode of a second embodiment of the printing apparatus.
Figure 12:
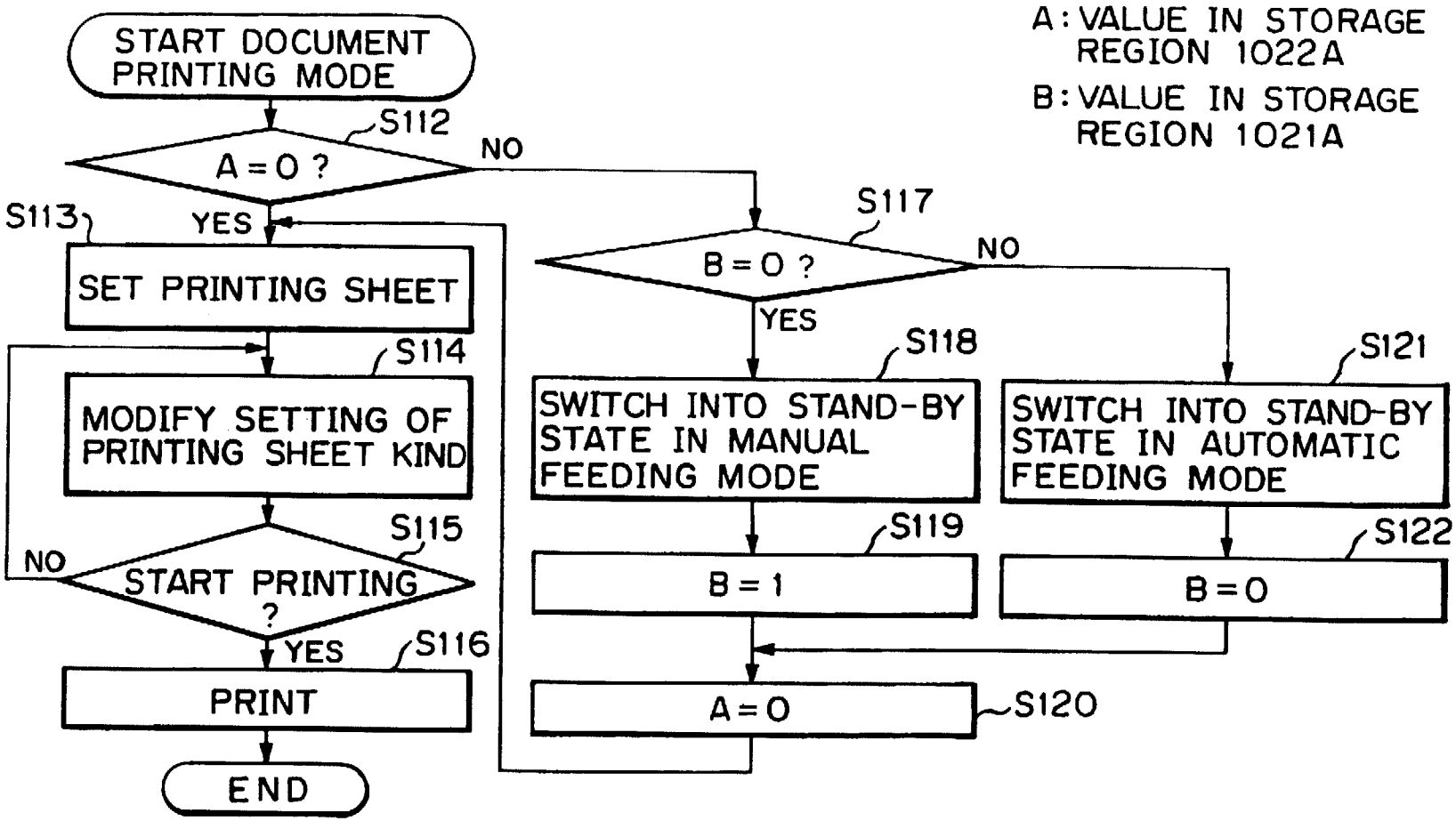
FIG. 12 is a flowchart showing a procedure of stand-by state switching process responsive to switching of the feeding mode in the document printing mode of the second embodiment.

FIGS. 11 and 12 are flowcharts showing similar processes in the document drafting mode and subsequent document printing mode as illustrated in FIGS. 8 and 9. Hereinafter, processes different from the foregoing first embodiment will be discussed.

In FIG. 11, at a step 102, when judgment is made that new document drafting is selected, kinds of the printing sheet as shown in FIG. 14 are displayed on a display portion 106 (see FIG. 7). Then, set input of the kind of the printing sheet is waited. When judgment is made that the set input of the kind of the printing sheet is made at a step S103, or when judgment is made that the already stored document is selected instead of drafting of new document at the step S102, the process is advanced to a step S104. At the step S104, the kind of the printing sheet as defined in the set input or the kind of printing sheet corresponding to the stored document which is selected, is judged if it is the registered kind of printing sheet for automatic feeding. This judgment can be performed by making reference to the content of table shown in FIG. 13.

In setting of the kind of the sheet at the step S103 and judgment of the registered kind of the sheet at the step S104, even when the printing sheet to be used for printing is the sheet size registered as the kind to perform automatic feeding, if the sheet to be used is not suitable for automatic feeding in the thickness, material or purpose of use, or is not desirable to be automatically fed, such as thin paper, thick paper, plastic plate, metal plate, back print film, cloth, shinning film and so forth, the printing sheet may be selected among columns of "special sheet" shown in FIG. 14. In the alternative, when selecting the portion of "others", arbitrary size of the printing sheet may be set.

As set forth above, at the step 104, judgment is made whether the printing sheet selected among the kinds of printing sheets shown in FIG. 14 is the kind registered for automatic feeding shown in FIG. 13. For example, when "normal DIN A4, portrait orientation is selected as the printing sheet, judgment can be made that the selected printing sheet is adapted to automatic feeding. Then, at a step 105, judgment is made whether the current feeding mode is the automatic feeding mode or not. Subsequently, at steps S106, S107 and so forth, the similar processes to the steps S6, S7 and so forth in the first embodiment, as illustrated in FIG. 8 are performed.

On the other hand, when "special sheet A4, portrait orientation" is already set or selected as the printing sheet, judgment is made that the selected kind of the printing sheet is not adapted for automatic feeding at the step S104. Then, at a step S108, check is performed whether the current feeding mode is the manual feeding mode or not. Subsequently, depending upon the judgment made at the step S108, the similar processes to the steps S8 and S9 of the first embodiment shown in FIG. 8 are performed at steps S108, S109 and so forth.

Once setting of data associated with the feeding mode switching operation through the process in the document drafting mode operation, when the document printing mode process shown in FIG. 12 is triggered, switching of the stand-by state of the feeding portion depending upon the set data is performed through the process shown in FIG. 12 (steps S118 or S121). A sequence of processes shown in FIG. 12 is similar to those of the first embodiment illustrated in FIG. 9. Therefore, detailed description of the processes in FIG. 12 is neglected for avoiding redundant discussion and thereby for keeping the disclosure simple enough to facilitate understanding of the invention.

A Third Embodiment

In the foregoing first and second embodiment, discussion has been given for the case where the set positions of the printing sheet in the automatic feeding mode and in the manual feeding mode are located on the common feeding path of the printing sheet. However, in case of known printing apparatus, in which the printing sheet set position in the automatic feeding mode and the printing sheet set position in the manual feeding mode are respectively located at different printing sheet feeding paths, it becomes unnecessary to switch the stand-by state the feeding portions to set the printing sheet set position in the automatic feeding mode or the printing sheet set position in the manual feeding mode. Therefore, in such case, it is only required to set either the automatic feeding mode or the manual feeding mode. Even by this, the equivalent effect may be attained.

It should be noted that while the registered condition of the printing sheet adapted for the automatic feeding is set in a range as illustrated in FIG. 13 in the foregoing first and second embodiments, since the printing sheets to be automatically fed are determined depending upon the specification of the apparatus, whether only a pair of the printing sheets among the printing sheets as listed in FIG. 13 are listed as the printing sheets to be recorded for automatic feeding, or in the alternative, when there are any other printing sheets which can be treated by automatic feeding in addition to those listed in FIG. 13, such additional printing sheets are recorded as the printing sheets for automatic feeding, can be arbitrarily selected. Therefore, the printing sheets which can be recorded as the printing sheets for automatic feeding are differentiated in each printing apparatus. In other words, the printing sheets to be recorded are not specified to those listed in FIG. 13. It is also possible to permit the user to arbitrarily set the printing sheets to be recorded as sheets for automatic feeding. Even in this way, the comparable effect to the foregoing embodiment may be obtained. Furthermore, the method for classification, display and selection of the kinds of the printing sheets should not be limited to that disclosed in the foregoing embodiment.

On the other hand, while the switching of the feeding mode (including the switching operation of the stand-by state of the feeding portion 4 in the first and second embodiment) is actually performed after starting the document printing mode operation on the basis of the information obtained by setting of the kind of printing sheets, the timing of switching the feeding mode may not be limited to the disclosed timing. For instance, equivalent effect may be obtained by requiring input of the condition of the kind of the printing sheet in advance of setting of the printing sheet at the printing sheet set position, and by providing a trigger for actually initiating switching of the feeding mode on the basis of the information obtained from input of the condition of the kind of the printing sheet.

Furthermore, it is also possible to instantly perform switching of the feeding mode at a timing performing setting of the kind of the printing sheet. In this case, the feeding mode switching storage region 1022A may not be necessary.

Figure 15:
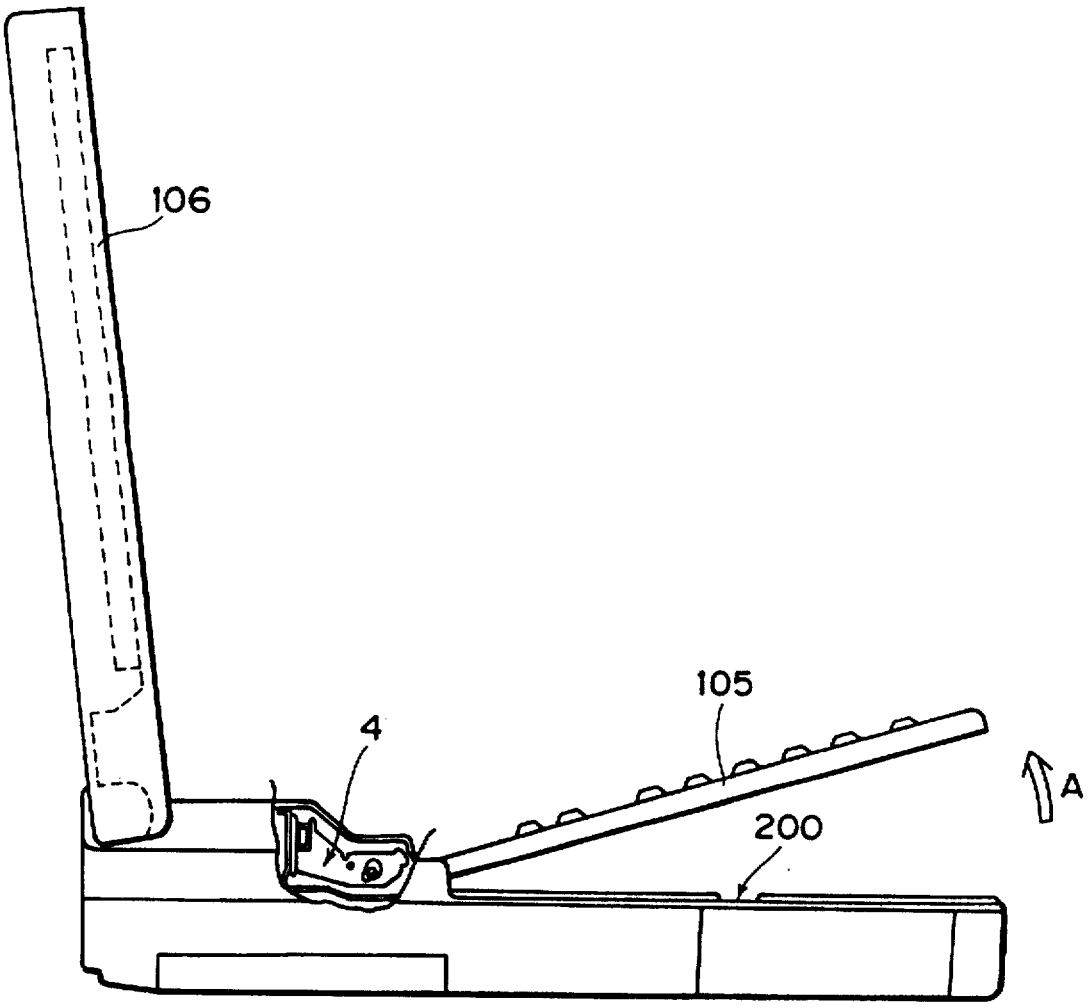
FIG. 15 is a general side elevation showing an example of construction of a laptop type personal computer capable of including a printing apparatus and an arrangement allowing a printing sheet to be set below a keyboard.

Also, for example, in case of the printing apparatus of the type having a sheet setting base 200 below the back side surface of the keyboard portion by forming the keyboard portion 105 in pivotal fashion as shown in FIG. 15, when the printing sheet is to be set for printing, the printing sheet has to be set on the sheet setting base 200 after pivoting the keyboard 105. In such case, a not shown switch for detected pivoting of the keyboard 105 in the direction A is provided to detect the pivotal motion of the keyboard by the switch.

Then, the detection of the pivotal motion of the keyboard as detected by the switch may be used as the trigger for switching the feeding mode to attain the similar effect.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus for performing printing on a printing medium by using a printing head, comprising:

feeding means for feeding the printing medium to a printing region, in which printing is performed by means of the printing head, said feeding means being operable in each of a plurality of feeding modes;

input means for inputting information relating to an editing format of a document;

mode judgment means for making judgment of the feeding mode based on a format of the printing medium corresponding to information input by said input means; and mode setting means for setting the feeding mode of said feeding means based on the judgment made by said mode judgment means.

2. A printing apparatus as claimed in claim 1, wherein the plurality of feeding modes, in which said feeding means is operable, differentiate a set position of the printing medium upon feeding from each other, and each of the set positions is located on a common feeding path.

3. A printing apparatus as claimed in claim 2, wherein said mode setting means sets the feeding mode to set a stand-by state of setting of the printing medium in said feeding means so that the set position is differentiated.

4. A printing apparatus as claimed in claim 3, wherein the plurality of feeding modes include an automatic feeding mode and a manual feeding mode.

5. A printing apparatus as claimed in claim 4, wherein said feeding means feeds the printing medium to the printing region from a position where the printing medium is set, in the automatic feeding mode.

6. A printing apparatus as claimed in claim 4, wherein said feeding means is not operative for feeding the printing medium toward the printing region from the set position where the printing medium is set and other feeding means performs feeding of the set printing medium, in the manual feeding mode.

7. A printing apparatus as claimed in claim 4, wherein the automatic feeding mode is a mode capable of feeding the printing medium by separating one printing medium from a stack of printing media set at the set position, and the manual feeding mode is a mode for feeding a single printing medium set at the set position thereof.

8. A printing apparatus as claimed in claim 1, wherein among the plurality of feeding modes, a first feeding mode is an automatic feeding mode capable of feeding the printing medium with separating one by one from a stack of plurality of printing media set at the set position, to the printing region, and a second feeding mode is a manual feeding mode for feeding a single printing medium set at the set position to the printing region, and the set position in the first feeding mode and the set position in the second feeding mode are located on mutually different feeding paths.

9. A printing apparatus as claimed in claim 1, wherein the information relating to the editing format includes information on a size of the printing medium.

10. A printing apparatus as claimed in claim 1, wherein the information relating to the editing format includes information on a kind of the printing medium.

11. A printing apparatus as claimed in claim 1, wherein said mode judgment means makes a judgment of the feeding mode by comparing an already-set feeding mode and the feeding mode registered depending upon information relating to the editing mode.

12. A printing apparatus as claimed in claim 1, wherein said printing head ejects an ink utilizing thermal energy.

* * * * *

UNITED STATES PATENT AND TRADEMARK OFFICE

CERTIFICATE OF CORRECTION

PATENT NO. : 5,816,716

DATED : October 6, 1998

INVENTOR(S) : NORIYUKI SUGIYAMA

It is certified that error appears in the above-identified patent and that said Letters Patent is hereby corrected as shown below:

Column 4

Line 57, "thereby" should read --is thereby--.

Column 5

Line 20, "contact" should read --contacts--;
Line 33, "are" should read --is--;
Line 51, "is erased the" should read --erases--;
Lines 53-54, "respectively of" should read --respectively,--;
Line 55, "stored," should read --stored--; and
Line 66, "ROM.A" should read --a ROM.--.

Column 6

Line 6, "command" should read --commands--; and
Line 34, "size" should read --sizes--.

UNITED STATES PATENT AND TRADEMARK OFFICE

CERTIFICATE OF CORRECTION

PATENT NO. : 5,816,716

DATED : October 6, 1998

INVENTOR(S) : NORIYUKI SUGIYAMA

It is certified that error appears in the above-identified patent and that said Letters Patent is hereby corrected as shown below:

Column 10

Line 2, "embodiment," should read --embodiments,--; and
Line 11, "state the" should read --state of the--.

Column 11

Line 45, "123670/1984and" should read --123670/1984 and--; and
Line 58, "consists" should read --consist--.

Signed and Sealed this

Twenty-sixth Day of September, 2000

*Attest:*

Q. TODD DICKINSON

*Attesting Officer*

*Director of Patents and Trademarks*